US009889351B2

(12) United States Patent
Slaughter et al.

(10) Patent No.: US 9,889,351 B2
(45) **Date of Patent: *Feb. 13, 2018**

(54) GOLF CLUB HAVING A REINFORCED BALL STRIKING PLATE

(71) Applicant: Karsten Manufacturing Corporation, Phoenix, AZ (US)

(72) Inventors: Byron C. Slaughter, Granbury, TX (US); William C. Knight, Granbury, TX (US); David N. Franklin, Granbury, TX (US); Jeremy Snyder, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/918,254

(22) Filed: Oct. 20, 2015

(65) Prior Publication Data

US 2016/0038797 A1 Feb. 11, 2016

Related U.S. Application Data

(63) Continuation of application No. 13/905,803, filed on May 30, 2013, now Pat. No. 9,168,436.
(Continued)

(51) Int. Cl.
*A63B 53/04* (2015.01)

(52) U.S. Cl.
CPC ..... *A63B 53/047* (2013.01); *A63B 53/04* (2013.01); *A63B 53/0466* (2013.01);
(Continued)

(58) Field of Classification Search
CPC ..... A63B 53/04; A63B 2209/02; A63B 2053/0462; A63B 53/0487;
(Continued)

(56) References Cited

U.S. PATENT DOCUMENTS 2,087,685 A 7/1937 Hackney
4,511,145 A 4/1985 Schmidt
(Continued)

FOREIGN PATENT DOCUMENTS

JP 2003220161 A 8/2003
JP 2003290398 A 10/2003
(Continued)

OTHER PUBLICATIONS

Feb. 4, 2014—(WO) International Search Report and Written Opinion—App PCT/US2013/043357—14 pages.

*Primary Examiner* — Sebastiano Passaniti

(57) ABSTRACT

A ball striking device includes a ball striking plate having a front surface configured to strike a ball and a rear surface opposite the front surface. The ball striking plate has a desired-contact region and a perimeter. One or more spoke-like reinforcement ribs may be located on the rear surface and may radiate away from the desired-contact region toward the perimeter. At least one of the spoke-like reinforcement ribs may be located in an upper-toe quadrant or in an upper-heel quadrant of the rear surface. One or more encircling reinforcement ribs may be located on the rear surface. The one or more encircling reinforcement ribs may be at least partially encircling the desired-contact region. A thickened portion of the ball striking plate may be positioned behind the desired-contact region of the ball striking plate. The ball striking device may be a golf club head.

20 Claims, 7 Drawing Sheets

Related U.S. Application Data

(60) Provisional application No. 61/654,057, filed on May 31, 2012.

(52) U.S. Cl.
CPC ... *A63B 53/0487* (2013.01); *A63B 2053/0416* (2013.01); *A63B 2053/0433* (2013.01); *A63B 2053/0454* (2013.01); *A63B 2053/0462* (2013.01); *A63B 2209/02* (2013.01)

(58) Field of Classification Search
CPC ..... A63B 2053/0454; A63B 53/047; A63B 53/0466; A63B 2053/0433; A63B 2053/0416
USPC ..... 473/324–350, 287–292
See application file for complete search history.

(56) References Cited

U.S. PATENT DOCUMENTS

| | | | | |
|---|---|---|---|---|
| D318,703 | S | 7/1991 | Shearer | |
| 5,377,985 | A | 1/1995 | Ohnishi | |
| 5,547,427 | A | 8/1996 | Rigal et al. | |
| 5,595,552 | A | 1/1997 | Wright et al. | |
| 5,649,872 | A * | 7/1997 | Antonious | A63B 53/04 473/332 |
| D386,550 | S | 11/1997 | Wright et al. | |
| D386,551 | S | 11/1997 | Solheim et al. | |
| D387,113 | S | 12/1997 | Burrows | |
| D387,405 | S | 12/1997 | Solheim et al. | |
| 5,718,641 | A | 2/1998 | Lin | |
| D392,356 | S | 3/1998 | Burrows | |
| 5,776,011 | A | 7/1998 | Su et al. | |
| D400,945 | S | 11/1998 | Gilbert et al. | |
| D401,652 | S | 11/1998 | Burrows | |
| D411,272 | S | 6/1999 | Burrows | |
| 5,954,596 | A | 9/1999 | Noble et al. | |
| 6,203,449 | B1 | 3/2001 | Kenmi | |
| D442,246 | S * | 5/2001 | McCabe | D21/759 |
| 6,454,665 | B2 | 9/2002 | Antonious | |
| 6,482,107 | B1 | 11/2002 | Urbanski et al. | |
| 6,746,343 | B2 * | 6/2004 | Yoneyama | A63B 53/04 473/342 |
| 6,756,343 | B1 | 6/2004 | Saitou et al. | |
| 6,840,872 | B2 | 1/2005 | Yoneyama | |
| 6,899,638 | B2 | 5/2005 | Iwata et al. | |
| 6,926,618 | B2 * | 8/2005 | Sanchez | A63B 53/04 473/329 |
| 7,387,579 | B2 | 6/2008 | Lin et al. | |
| 7,442,132 | B2 | 10/2008 | Nishio | |
| 7,614,964 | B2 | 11/2009 | Matsunaga | |
| 7,618,331 | B2 | 11/2009 | Hirano | |
| 8,012,041 | B2 | 9/2011 | Gibbs et al. | |
| 8,070,623 | B2 | 12/2011 | Stites et al. | |
| 8,382,609 | B2 | 2/2013 | Yokota | |
| 8,439,769 | B2 | 5/2013 | Rice et al. | |
| 8,535,177 | B1 * | 9/2013 | Wahl | A63B 69/3635 473/290 |
| 8,574,095 | B2 | 11/2013 | Hirano | |
| 8,690,702 | B2 | 4/2014 | Abe | |
| 8,696,489 | B2 | 4/2014 | Gibbs et al. | |
| 8,814,724 | B2 | 8/2014 | Kato | |
| 8,845,454 | B2 | 9/2014 | Boyd et al. | |
| 9,168,436 | B2 * | 10/2015 | Slaughter | A63B 53/04 |
| 2001/0001774 | A1 | 5/2001 | Antonious | |
| 2006/0194644 | A1 | 8/2006 | Nishio | |
| 2008/0004129 | A1 | 1/2008 | Lin et al. | |
| 2008/0032817 | A1 | 2/2008 | Lo | |
| 2008/0125246 | A1 * | 5/2008 | Matsunaga | A63B 53/0466 473/346 |
| 2010/0267461 | A1 | 10/2010 | Stites | |
| 2010/0304889 | A1 | 12/2010 | Wada et al. | |
| 2011/0201451 | A1 | 8/2011 | Wada et al. | |
| 2012/0064994 | A1 | 3/2012 | Wada et al. | |
| 2012/0283036 | A1 | 11/2012 | Stites et al. | |

FOREIGN PATENT DOCUMENTS

| | | | |
|---|---|---|---|
| JP | 3124540 | U | 8/2006 |
| JP | 3126137 | U | 10/2006 |
| JP | 2010035586 | A | 2/2010 |
| JP | 2010253247 | A | 11/2010 |
| JP | 2011092243 | A | 5/2011 |

* cited by examiner

GOLF CLUB HAVING A REINFORCED BALL STRIKING PLATE

RELATED APPLICATIONS

This application is a continuation of U.S. application Ser. No. 13/905,803, filed May 30, 2013, which claims the benefit and priority of U.S. Provisional Application No. 61/654,057, filed May 31, 2012, the contents of which are hereby incorporated by reference in its entirety.

TECHNICAL FIELD

The invention relates generally to ball striking devices having a reinforced ball striking plate. Certain aspects of this invention relate to ball striking devices, such as golf clubs and golf club heads, having one or more reinforcement elements located on a back surface of the ball striking plate.

BACKGROUND

The energy or velocity transferred to the ball by a golf club or other ball striking device may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at or near the center of the ball striking face. In one example, the area of highest response may have a COR that is equal to the prevailing USGA limit (e.g. currently 0.83). However, because golf clubs are typically designed to contact the ball at or around the center of the face, off-center hits with many existing golf clubs may result in less energy being transferred to the ball, decreasing the distance of the shot.

The flexing behavior of the ball striking face and/or other portions of the head during impact can also influence the energy and velocity transferred to the ball, the direction of ball flight after impact, and the spin imparted to the ball, among other factors. Accordingly, a need exists to alter and/or improve the deformation and response of the ball striking face and/or other portions of the head during impact. The flexing behavior of the ball itself during impact can also influence some or all of these factors. Excess deformation of the ball during impact can result in energy loss, such as in the form of heat. Certain characteristics of the face and/or other portions of the head during impact can have an effect on the deformation of the ball. Accordingly, a need also exists to provide a ball striking head with features that cause altered and/or improved deformation behavior of the ball during impacts with the ball striking face of the head.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

According to aspects of the invention, a ball striking device includes a ball striking plate having a front surface configured to strike a ball and a rear surface opposite the front surface. The ball striking plate has a desired-contact region and a perimeter. The ball striking device further includes one or more reinforcement ribs located on the rear surface.

The reinforcement ribs may include spoke-like reinforcement ribs that extend away from the desired-contact region toward the perimeter. Further, a first end of a spoke-like reinforcement rib extending away from the desired-contact region may lie within the desired-contact region, contact a boundary of the desired-contact region, or lie outside of the desired-contact region. Further a second end of a spoke-like reinforcement rib extending toward a perimeter of the ball striking plate may fall short of the perimeter, or may reach the perimeter. The perimeter may be defined by a frame.

According to certain aspects, the reinforcement ribs may include one or more spoke-like reinforcement ribs that are radially-aligned with a predetermined point located within the desired-contact region of the ball striking plate. The spoke-like reinforcement ribs may be formed as elongated linear elements and/or as elongated curved elements. A plurality of the spoke-like reinforcement ribs may be located in an upper-toe quadrant and/or in an upper-heel quadrant of the rear surface. Alternatively, or in addition, a plurality of the spoke-like reinforcement ribs may be located in a lower-toe quadrant and/or in a lower-heel quadrant of the rear surface. At least some of the reinforcement ribs may be evenly spaced (angularly or otherwise) from one another. One or more of the spoke-like reinforcement ribs may have a maximum cross-sectional area ranging from 0.10 $mm^2$ to 0.70 $mm^2$. The cross-sectional area may be constant along the length of the rib or it may decrease as the rib extends outward.

According to other aspects, the reinforcement ribs may include one or more encircling reinforcement ribs. An encircling reinforcement rib may completely or at least partially encircle the desired-contact region. A partially encircling rib may extend between portions of the perimeter of the ball striking plate. A plurality of encircling reinforcement ribs may have a constant, increasing or otherwise varying spacing between adjacent ribs as the distance from the desired-contact region increases.

A spoke-like reinforcement rib may extend away from the desired-contact region and an encircling reinforcement rib may at least partially encircle the desired-contact region. When both spoke-like and encircling reinforcement ribs are provided, they may intersect to form a web or network of ribs.

According to even further aspects, the ball striking plate may be provided with a thickened portion positioned behind the desired-contact region of the ball striking plate. The thickened portion may include an elevated area on the rear surface of the ball striking plate and a transition area. The transition area may taper in thickness between an upper boundary of the elevated area and a lower boundary of the thickened portion. The thickened portion may have any suitable shape, including, for example, a peanut shape or a kidney shape. The elevated area may have a maximum thickness of that ranges from approximately 2.5 mm to approximately 3.5 mm. A peripheral portion that surrounds the thickened portion may have a minimum thickness less than approximately 2.0 mm.

Spoke-like reinforcement ribs may contact and extend from the thickened portion. Encircling reinforcement ribs may have the same general shape as the shape of the thickened portion.

According to certain aspects, the ball striking plate may be connected to a body to thereby form a golf club head. A shaft may be engaged with the golf club head to form a golf club.

These and additional features and advantages disclosed here will be further understood from the following detailed disclosure taken in conjunction with the attached drawings.

BRIEF DESCRIPTION OF THE DRAWINGS

To allow for a more full understanding of the present invention, it will now be described by way of example, with reference to the following drawings.

FIG. 6 is a rear view of the head of a ball striking device, with a portion of a frame cut away to better view a rear surface of a ball striking plate.

FIGS. 7-13 are rear views of the head of a ball striking device, with a portion of a frame cut away to better view a rear surface of the ball striking plate.

Figure 1:
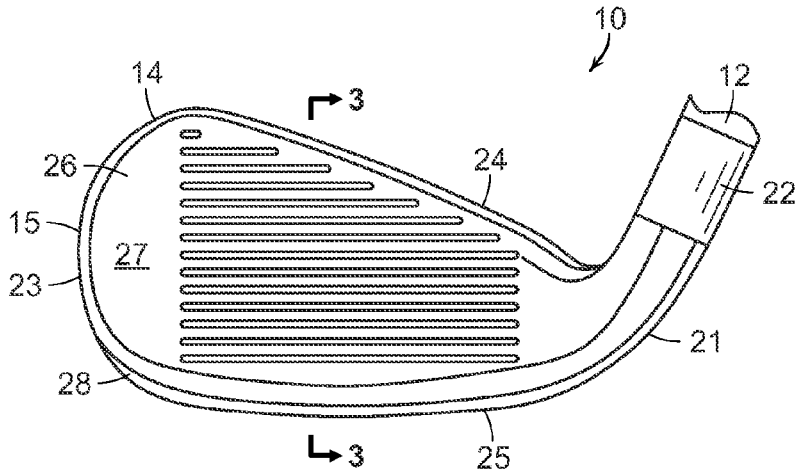
FIG. 1 is a front view of an embodiment of a ball striking device according to aspects of the invention, in the form of an iron-type golf club head and having a shaft (partially shown) attached to form a golf club.

The various figures in this application illustrate examples of ball striking devices and portions thereof according to this invention. The figures referred to above are not necessarily drawn to scale, should be understood to provide a representation of particular embodiments of the invention, and are merely conceptual in nature and illustrative of the principles involved. Some features of the ball striking devices depicted in the drawings may have been enlarged or distorted relative to others to facilitate explanation and understanding. When the same reference number appears in more than one drawing, that reference number is used consistently in this specification and the drawings to refer to similar or identical components and features shown in the various alternative embodiments.

DETAILED DESCRIPTION

A general description of aspects of the invention followed by a more detailed description of specific embodiments follows. It is to be understood that other specific arrangements of parts, structures, example devices, systems, and steps may be utilized and structural and functional modifications may be made without departing from the scope of the present invention. It is expected that ball striking devices as disclosed herein would have configurations and components determined, in part, by the intended application and environment in which they are used. Thus, for certain specific embodiments the dimensions and/or other characteristics of the ball striking device structures according to aspects of this invention may vary significantly without departing from the invention.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, table tennis paddles, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

"Integral joining" means a technique for joining two pieces so that the two pieces effectively become a single, integral piece, including, but not limited to, irreversible joining techniques, such as adhesively joining, cementing, welding, brazing, soldering, or the like. In many bonds made by "integral joining," separation of the joined pieces cannot be accomplished without structural damage thereto.

"Approximately" incorporates a variation or error of +/−10% of the nominal value stated.

"Generally constant thickness" incorporates a variation or error of +/−5% of the average thickness over the entirety of the area in question.

"Desired-contact" region refers to the as-designed, optimal region of the ball striking plate for contacting the ball or other struck object. This "desired-contact" region is sometimes referred to, informally, as the "sweet spot." For purposes of this disclosure, the desired-contact region is considered to extend through the thickness of the ball striking plate, i.e., the region is not limited to the front surface of the ball striking plate. The desired-contact region may generally be centered on the geometric center of the ball striking plate. Further, the desired-contact region may be defined as the area of the ball striking plate that is capable of achieving at least 99.7% of the maximum ball speed achievable by the ball striking device. Alternatively, the desired-contact region may be defined as the area of the ball striking plate that is capable of achieving at least 99.5% or even at least 99.0% of the maximum ball speed achievable by the ball striking device. By way of example, for ball striking devices which are golf clubs the desired-contact region may have an area generally ranging from approximately 50 $mm^2$ to approximately 250 $mm^2$. It is expected that other ball striking devices may have different areas of the desired-contact regions.

"Central" region refers to a circular region generally centered on the geometric center of the ball striking plate. The central region may have an area generally greater than approximately 50 $mm^2$, greater than approximately 70 $mm^2$, greater than approximately 90 $mm^2$, greater than approximately 110 $mm^2$, greater than approximately 130 $mm^2$, greater than approximately 150 $mm^2$, or even greater than approximately 200 $mm^2$. In certain embodiments, the central region may have an area generally ranging from approximately 50 $mm^2$ to approximately 250 $mm^2$, from approximately 70 $mm^2$ to approximately 200 $mm^2$, or from approximately 90 $mm^2$ to approximately 200 $mm^2$.

"Spoke-like" element refers an elongated element extending away from a predetermined point (such as a geometric center of the ball striking plate or other point) or an elongated element extending away from a predetermined region (such as a desired-contact region, a central region or other region) toward a perimeter. "Spoke-like" does not imply any particular elongated profile. Thus, a spoke-like element may be linear or curved. A spoke-like element may be "radially-aligned," i.e., radiating away from or extending through a predetermined point such as the geometric center (or aligned with the predetermined point/geometric center without actually extending to or through the predetermined point/geometric center). For example, spokes of an old-fashioned wagon wheel are "radially-aligned." Alternatively, a spoke-like element may be "radially-skewed," i.e., extending away from a desired-contact region or a central region without actually being aligned with a predetermined point or a geometric center. For example, the metal spokes of most modern bicycle wheels are "radially-skewed" in that they are not actually aligned with the center of the hub, but rather extend outward from a circumferential edge of the hub. Further, a spoke-like element may extend toward a perimeter without actually extending to or reaching the perimeter.

"Encircling" means at least partially extending around, surrounding, circumscribing, etc, an encircled item, but does not imply any particular shape or contour, such as circular, elliptical, etc. unless otherwise specified. "Completely encircling" means that the encircling feature extends 360 degrees around the encircled item.

The term "thickness" or "plate thickness," when used in reference to a ball striking plate as described herein refers to the distance between the front surface of the ball striking plate and the rear surface of the ball striking plate. The thickness is generally the distance between a point on the front surface of the ball striking plate and the nearest point on the rear surface of the plate, respectively, and may be measured perpendicularly to the front or rear surface at the point in question.

A. General Description of Ball Striking Devices and Ball Striking Plates According to Aspects of the Invention In general, aspects of this invention relate to ball striking devices having a ball striking plate. Such ball striking devices, according to at least some examples of the invention, may include a ball striking head and a shaft, wherein the head includes the ball striking plate.

Aspects of the invention relate to ball striking devices with a head that includes a ball striking plate configured for striking a ball. Various example structures include ball striking plates that are provided with reinforcement elements, such as reinforcement ribs. Reinforcement ribs are elongated elements. Thus, according to certain aspects, the thickness in certain areas of the striking plate may be reduce (relative to a constant thickness striking plate), thereby resulting in a weight reduction, while maintaining the desired structural integrity of these areas via the presentment of the reinforcement elements. The overall weight saved due to the reduced-thickness plate portions may be discretionarily placed elsewhere on the head, thereby allowing improved control of mass characteristics (e.g., moment-of-inertia, center-of-gravity, etc.) and/or vibration characteristics.

Further, various example structures of ball striking plates described herein may include a thickened portion that forms a raised platform or elevated area extending rearwardly from a rear surface of the striking plate. Thus, the striking plate may have an elevated or thickened area protruding from the rear surface and having increased thickness relative to a surrounding peripheral portion of the plate. The thickened portion may be positioned behind the geometric center of the striking plate. Further, the thickened portion may be positioned behind at least a portion of the desired-contact region or the central region of the striking plate. In some embodiments, the thickened portion may extend completely over and possibly beyond the perimeter of the desired-contact region or the central region of the striking plate. U.S. patent application Ser. No. 13/211,961, filed Aug. 17, 2011, titled "Golf Club or Other Ball Striking Device Having Stiffened Face Portion," which is incorporated by reference herein in its entirety and made part hereof, discloses thickened portions on rear surfaces of ball striking plates.

The thickened portions and/or elevated areas may have shapes that are elongated and may be elliptical or semi-elliptical, multi-lobed, or generally peanut- or kidney-shaped. In certain embodiments, the thickened portion may have an outer edge defining a shape that includes two lobes (i.e., a portion where the outer edge has a generally convex outer profile), and a connecting portion extending between the lobes. The connecting portion is defined by outer edges extending between the outer edges of the lobes, with at least one of the outer edges of the connecting portion having a concave profile. If only one of the outer edges of the connecting portion is concave, the resultant shape may be what is referred to as a kidney-shaped thickened portion. If both of the outer edges of the connecting portion are concave, the resultant shape may be what is referred to as a peanut-shaped thickened portion.

In general, the thickened portion and/or the elevated area may assume any shape. For example, the elevated level of the thickened portion may be generally circular, oval, elliptical, tear-drop shaped, pear shaped, square, rectangular, triangular, trapezoidal, polygonal (with or without rounded corners and/or with straight or curved edges). Further, the lobed shapes need not be limited to double-lobed shapes, but may be triple-lobed or quadruple-lobed (or with even a higher number of lobes). Even further, the thickened portion and/or the elevated area need not have a regular geometric shape, nor need it be symmetrically shaped. Thus, for example, the thickened portion and/or the elevated area may have an amorphous, curved, amoeba-like shape.

The thickened portion and/or the elevated area may be elongated along an axis of elongation. This axis of elongation would typically be coincident with the maximum planar dimension of the thickened portion and/or elevated area. The angle of the axis of elongation may be based on typical ball striking patterns. A typical angle (counterclockwise from the horizontal when viewed from the rear surface) for the axis of elongation may be between 0°-15° or 0°-20°. In various other embodiments, the angle for the axis of elongation may be limited to between 5°-15° or 5°-18°. Thus, it is to be understood that the thickened portion may have a different orientation and/or axis of elongation for any specific ball striking device.

Additionally, according to some embodiments, the dimensions measured along a second axis perpendicular to the axis of elongation may vary. Thus, for example, a double-lobed thickened portion may have a first axis, wherein the lobes each have dimensions measured along a second axis perpendicular to the first axis, and the lobes are wider (i.e. have greater dimensions perpendicular to the axis of elongation) than the connecting area, which is narrowed with respect to the lobes. Optionally, the thickened portion may be a triple-lobed shape.

According to some aspects, the thickened portion may have a generally constant thickness. In certain embodiments, the elevated area may be a plateau area having a generally constant thickness over the entire area within the upper boundary of the annular or encircling tapered area. According to other embodiments, the elevated area need not be constant, but may be stepped, slanted, faceted, convexly domed, concave, etc.

Optionally, the thickened portion may further include a transition area that tapers in thickness between a first upper boundary (or upper contour edge) and a first lower boundary (or lower contour edge). The transition area may be an annular or encircling transition area that encloses or substantially encloses the elevated area. The change in thickness of this transition area as it extends from the upper contour edge to the lower contour edge may be constant (i.e. linear), may be curvilinear and/or may follow a regular mathematical relationship (i.e. parabolic, hyperbolic, semi-circular, semi-elliptical), may be instantaneous (e.g. a 90° drop), or may be irregular or may follow a different pattern. Additionally, the transition profile (i.e., the profile from the upper edge to the lower edge) of the transition area may be the same over the entirety of its annular extent or may be different in different locations of the annulus. At the lower boundary, the transition area may smoothly merge into the rear surface of the ball striking plate.

The elevated area and the transition area may be considered together to form the thickened portion relative to the peripheral portion of the ball striking plate.

Further, according to some aspects, the thickened portion may have multiple elevated levels and/or multiple transition areas. When multiple elevated levels are provided, the individual levels may be stacked with lower levels having larger areal footprints than upper levels (e.g., like a Mayan stepped pyramid). When multiple elevated levels are provided, the contour or perimeter shape of each of the elevated levels may be the same. Optionally, the contour of the elevated levels may differ from one another, not only in size, but in shape and/or orientation. Further, one or more multiple transition areas may extend between the plurality of elevated levels and may be formed as sloped or tapered regions having thicknesses that gradually increase or decrease between the boundary edges of the various elevated levels.

According to certain aspects, typically for golf clubs, the thickened portion of the ball striking plate may cover a total area that ranges from approximately 75 $mm^2$ to approximately 3000 $mm^2$. The lower end of the range may be more appropriate for irons, while the upper end of the range may be more appropriate for drivers. In some embodiments, the thickened portion of the striking plate may be very localized, such that it covers a total area that ranges only from approximately 75 $mm^2$ to approximately 150 $mm^2$ or, optionally, from approximately 75 $mm^2$ to approximately 250 $mm^2$. In some embodiments, the thickened portion may be less localized, such that it covers a total area that ranges from approximately 250 $mm^2$ to approximately 500 $mm^2$, from approximately 250 $mm^2$ to approximately 750 $mm^2$, or even from approximately 250 $mm^2$ to approximately 1000 $mm^2$. In other embodiments, the thickened portion of the ball striking plate may be somewhat larger, such that it covers a total area that ranges from approximately 750 $mm^2$ to approximately 1250 $mm^2$, from approximately 1000 $mm^2$ to approximately 1250 $mm^2$, or even from approximately 1000 $mm^2$ to approximately 1500 $mm^2$.

According to some aspects, the thickened portion may have a maximum thickness of approximately 2.00 mm to approximately 4.50 mm. More typically, the thickened portion may have a maximum thickness of approximately 2.50 mm to approximately 4.00 mm. Alternatively, the thickened portion may have a maximum thickness of approximately 2.25 mm to approximately 3.75 mm, a maximum thickness of approximately 2.50 mm to approximately 3.5 mm, or even a maximum thickness of approximately 2.50 mm to approximately 3.25 mm. As noted above, this thickness may be substantially constant in the elevated areas 132. Further, these thicknesses may be especially suitable for golf clubs having metallic ball striking plates.

Generally, a peripheral portion extends from the thickened portion to a perimeter of the ball striking plate. The perimeter of the ball striking plate may be coincident with an inner edge of a frame extending at least partially around the ball striking plate. The peripheral portion may have a constant thickness or a varying thickness. In any event, a minimum thickness for the peripheral portion may be determined. According to some aspects, the peripheral portion may have a minimum thickness of approximately 1.20 mm to approximately 2.50 mm. More typically, the peripheral portion may have a minimum thickness of approximately 1.40 mm to approximately 2.10 mm. Alternatively, the peripheral portion may have a minimum thickness of approximately 1.50 mm to approximately 2.00 mm, a minimum thickness of approximately 1.60 mm to approximately 1.90 mm, or even a minimum thickness of approximately 1.65 mm to approximately 1.85 mm. These thicknesses may be especially suitable for golf clubs having metallic ball striking plates.

Alternatively, the maximum thickness of the thickened portion may be disclosed as an increase in thickness relative to a minimum thickness of the surrounding peripheral portion. Thus, according to some embodiments, the maximum thickness of the thickened portion may range from 125% to 200% of the minimum thickness of the surrounding peripheral portion, i.e., the increase in thickness may range from 25% to 100% of the minimum thickness. For example, if the maximum thickness is 175% of the minimum thickness, and if the minimum thickness of the peripheral region was approximately 1.90 mm, then the maximum thickness of the thickened portion would be approximately 3.33 mm.

According to even other aspects, the total volume of material in the thickened portion of the ball striking plate may be a consideration. For example, should the thickened portion have an area of 500 $mm^2$ and a constant thickness of 3.00 mm, the total volume of the thickened portion would be 1.50 $cm^3$. In general, for certain golf club heads, a total volume of the thickened portion of the ball striking plate of between 0.50 $cm^3$ and 2.50 $cm^3$ may be desirable, particularly if the ball striking plate is formed of a metal such as steel or titanium. Optionally, a total volume of the thickened portion between 0.50 $cm^3$ and 1.00 $cm^3$ for lightly loaded ball striking plates may be desirable, while a total volume of the thickened portion between 1.50 $cm^3$ and 2.50 $cm^3$ for more severely loaded ball striking plates may be more appropriate.

According to aspects of the invention, the ball striking plate of the ball striking device may have one or more reinforcement elements. Reinforcement elements may include reinforcement ribs on the rear surface of the plate. Reinforcement ribs may be formed as relatively long, thin members or elongated, raised strips, beads, filaments, fins, protrusions, etc. extending across the rear surface the plate. The reinforcement ribs may provide increased stiffness to certain areas or portions of the ball striking plate, and may therefore be considered to constitute stiffening members.

Reinforcement ribs may be used to efficiently focus and channel the loads experienced due to striking the ball at or near a geometric center, a desired-contact region and/or a center region of the striking plate to the perimeter of the ball striking place. A frame or other body member extending around the perimeter may then react and dissipate the loads. Further, reinforcement ribs may more efficiently react out-of-plane vibrational loads (as compared to a constant thickness flat plate). Thus, reinforcement ribs may allow the overall thickness of the ball striking plate to be reduced by selectively reinforcing the primary load carrying paths of the ball striking plate.

According to certain aspects, the thickened portion may be provided in addition to the reinforcement ribs. Thus, the reinforcement ribs may be provided on the relatively thin peripheral portion of the ball striking plate. One or more reinforcement ribs may extend away from the thickened portion or the central region toward the perimeter of the ball striking plate. According to some embodiments, a first end of a reinforcement rib may be joined to the thickened portion and a second end may be joined to a frame extending around the perimeter. One or more reinforcement ribs may extend around a predetermined point, a geometric center, a desired-contact region, or a central region. Thus, according to some embodiments, the reinforcement ribs need not extend from or radiate from the thickened portion.

According to some aspects, the reinforcement ribs may be spoke-like reinforcement ribs. As such, the spoke-like reinforcement ribs may radiate or extend away from the desired-contact region or the central region toward the perimeter of the ball striking plate. In certain embodiments, the spoke-like reinforcement ribs may be radially-aligned with a point on the ball striking plate. For example the spoke-like reinforcement ribs may be radially-aligned with the geometric center of the ball striking plate. According to other embodiments, one or more of the spoke-like reinforcement ribs may be radially-skewed from any particular point on the ball striking plate.

The angular spacing between adjacent spoke-like reinforcement ribs may or may not be equal. Optionally, a plurality of spoke-like reinforcement ribs may extend in parallel away from a predetermined point or region of the ball striking plate toward the perimeter of the plate. Even further, the spacing and angular orientation of the spoke-like reinforcement ribs may appear random or disorganized.

According to certain aspects, the reinforcement ribs may be encircling reinforcement ribs that at least partially encircle the geometric center of the ball striking plate. Optionally, the encircling reinforcement ribs may at least partially encircling the desired-contact region, the central region and/or the thickened portion. One or more of the encircling reinforcement ribs may extend completely around the geometric center. Such an encircling reinforcement rib may form a closed rib. One or more of the encircling reinforcement ribs may extend only partially around the geometric center. In such case, the encircling reinforcement rib may from an open rib. Optionally, the encircling reinforcement rib may extend from one portion of the perimeter of the ball striking plate to another portion of the perimeter of the ball striking plate.

The spacing between adjacent encircling reinforcement ribs may increase as the distance from the geometric center increases. In other embodiments, this spacing between adjacent encircling reinforcement ribs may be constant or may decrease as the distance from the predetermined point, the geometric center, the desired-contact region or the center region increases. In even other embodiments, the spacing between any two adjacent encircling reinforcement ribs may be constant as the ribs extend around the geometric center. Alternatively, the spacing between any two adjacent encircling reinforcement ribs may increase and/or decrease as the ribs extend around the geometric center or other point.

A reinforcement rib may have any suitable cross-section and any suitable cross-sectional area. The cross-sectional shape and/or the cross-sectional area of any one reinforcement rib may be constant or may vary along its length. Further, the cross-sectional characteristics of the reinforcement ribs need not be the same for every rib. By way of example, according to certain aspects, a reinforcement rib may have a maximum height (i.e., a height above the rear surface of the ball striking plate) that ranges from approximately 0.10 mm to approximately 2.0 mm. By way of example, a reinforcement rib may have a maximum height that ranges from approximately 0.20 mm to approximately 1.5 mm, from approximately 0.20 mm to approximately 1.0 mm, from approximately 0.20 mm to approximately 0.80 mm, or even from approximately 0.20 mm to approximately 0.60 mm. As an example, a reinforcement rib may have a height of approximately 0.40 mm.

According to certain other aspects, a reinforcement rib may have a maximum width that ranges from approximately 0.10 mm to approximately 3.0 mm. By way of example, a reinforcement rib may have a maximum width that ranges from approximately 0.20 mm to approximately 2.5 mm, from approximately 0.50 mm to approximately 2.0 mm, from approximately 1.0 mm to approximately 2.0 mm, or even from approximately 1.20 mm to approximately 1.80 mm. As an example, a reinforcement rib may have a width of approximately 1.0 mm.

These example numerical ranges for the maximum heights and widths of the reinforcement ribs may be especially appropriate for metallic ball striking plates. Further, reinforcement ribs having a height-to-width ratio ranging from 0.2 to 2.0 may be desirable. Even further, reinforcement ribs having a height-to-plate thickness ratio of 0.10 to 0.5 may be desirable.

In accordance with some aspects, the reinforcement rib may have a maximum cross-sectional area that ranges from approximately 0.10 $mm^2$ to approximately 1.00 $mm^2$. Optionally, a reinforcement rib having a maximum cross-sectional area that ranges from approximately 0.20 $mm^2$ to approximately 0.90 $mm^2$, from approximately 0.30 $mm^2$ to approximately 0.80 $mm^2$, from approximately 0.30 $mm^2$ to approximately 0.70 $mm^2$, or even from approximately 0.30 $mm^2$ to approximately 0.60 $mm^2$ may provide suitable reinforcement and/or stiffening.

In certain embodiments, both spoke-like reinforcement ribs and encircling reinforcement ribs may be provided. Where encircling reinforcement ribs cross over spoke-like reinforcement ribs they may intersect.

The reinforcement ribs (and the thickened portion) described herein may increase energy transfer and impact velocity for impacts between the ball striking surface and a ball. The reinforcement ribs and the thickened portion may create a stiffened center portion of the ball striking plate, which permits other areas of the plate to be made more flexible (such as by decreasing the thickness). This may result in a more gradual impact (longer dwell time) with the ball, which in turn may decrease overall ball deformation. Because significant energy loss can occur with excessive ball deformation, the reinforced configuration of the ball striking plate may result in less overall energy loss and greater energy and velocity upon impact.

In certain embodiments, a frame may extend rearwardly from the perimeter of the ball striking plate. The frame in conjunction with the striking plate may have a cup-like configuration, with walls extending rearwardly from the entire perimeter of striking plate. Optionally, the frame in conjunction with the ball striking plate may have a generally U-shaped cross-sectional configuration, with the frame extending rearwardly from both a top section or a bottom section of the perimeter edges of striking plate. In certain embodiments, the frame in conjunction with plate may have a generally L-shaped cross-sectional configuration, i.e., the frame extends rearwardly from just one of the top section or bottom section perimeter edges of the ball striking plate.

The frame (if any) around the ball striking plate and/or other portions of the ball striking device may flex during impact to cooperate with the ball striking plate to reduce ball deformation and thereby increase the return energy and velocity on impact. Additionally, the stiffened center portion and more flexible peripheral portions of the ball striking plate may increase the trampoline effect of the plate. The thickened portion and reinforcement ribs may also reduce stresses and strains in the ball striking plate, thereby increasing the durability and usable life of the plate. Still further benefits may be recognized and appreciated by those skilled in the art.

According to another aspect, the ball striking device is a golf club having a golf club head. The golf club head may include a cavity. The cavity may be completely enclosed by the ball striking plate and at least one body member, or the cavity may be at least partially open.

Other aspects relate to a golf club that includes a golf club head as described above and a shaft engaged with the head. Further aspects relate to a set of golf clubs, particularly, a set of iron-type clubs, that includes at least one club head according to aspects described above.

Some more specific aspects of this invention may relate to golf clubs, such as drivers, fairway woods, hybrid-type clubs, iron-type golf clubs, and the like, although aspects of this invention also may be practiced on other types of golf clubs or other ball striking devices, if desired. Although the following description uses golf clubs to exemplify the various aspects of the invention, it is to be understood that the invention is not limited to golf clubs.

According to various aspects of this invention, the ball striking device and/or any of its components, may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, composite components, such as carbon fiber-polymer composites, can be manufactured by a variety of composite processing techniques, such as pre-preg processing, powder-based techniques, mold infiltration, and/or other known techniques. Also, if desired, the club heads may be made from any number of pieces (e.g., having a separate face plate, etc.) and/or by any construction technique, including, for example, casting, forging, welding, and/or other methods known and used in the art.

In general, aspects of the present invention relate to structural features for providing ball striking plate with improved performance and durability characteristics. Specific examples of the various aspects are described in more detail below. The reader should understand that these specific examples should not be construed as limiting the invention.

B. Detailed Description of Specific Embodiments

At least some examples of ball striking devices according to this invention relate to golf club head structures, including heads for wood-type golf clubs, including drivers. Such devices may include a one-piece construction or a multiple-piece construction.

FIGS. 1-5 illustrate an embodiment of a ball striking device 10. More particularly, FIGS. 1-5 illustrate a ball striking device 10 generally representative of any iron-type golf club head, in accordance with at least some examples of this invention.

The ball striking device 10 includes a ball striking head 14 and a shaft 12 connected to the ball striking head 14 and extending therefrom. The shaft 12 of ball striking device 10 may be made of various materials such as steel, titanium, graphite, wood, polymers, composite materials, etc., as would be known to persons of skill in the art. A grip (not shown) may be positioned on the shaft 12 to provide a user with a slip resistant surface on which to grasp ball striking device 10.

As shown in FIG. 1-5, the head 14 comprises a body 15 that includes a heel edge 21 and edge toe 23, the body 15 extending between the heel edge 21 and the toe edge 23. In this particular embodiment, a hosel 22 is provided for connecting the shaft 12 to the head 14. The body 15 also includes a top edge 24 and a sole edge 25. A ball striking plate 26 extends between the top edge 24 and the sole edge 25 and between the toe edge 23 and the heel edge 21.

Figure 2:
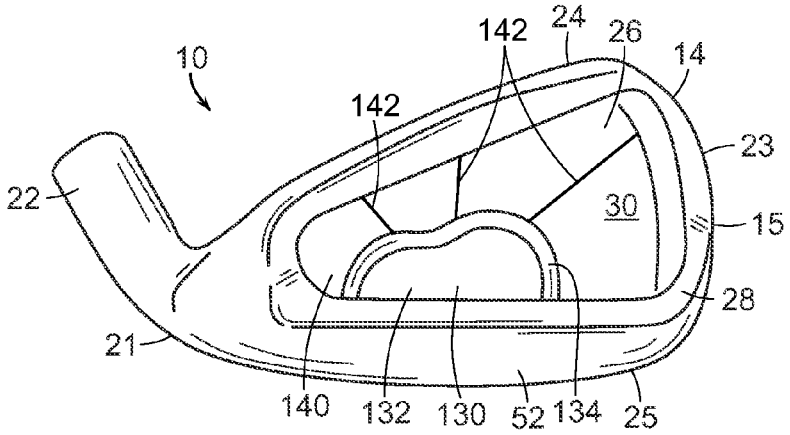
FIG. 2 is a rear view of the head of the ball striking device of FIG. 1.
Figure 3:
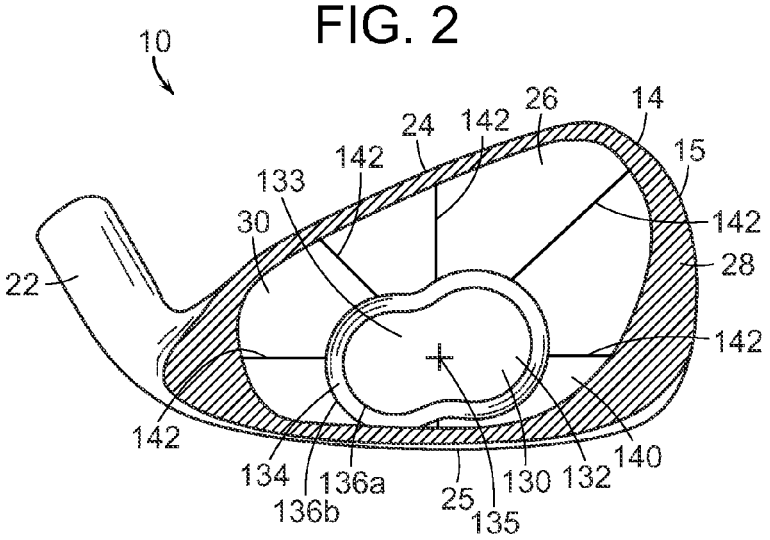
FIG. 3 is a rear view of the head of the ball striking device of FIG. 1 with a portion of a frame of the head cut away to better view the rear surface of the ball striking plate.

As best shown in FIG. 2, the body 15 may include a frame 28 extending at least partially around the perimeter of the striking plate 26. Further, the frame 28 may extend rearwardly from a perimeter of the striking plate 26. In this particular embodiment, frame 28 in conjunction with striking plate 26 has a cup-like configuration, with walls extending rearwardly from the entire perimeter of striking plate 26.

Figure 4:
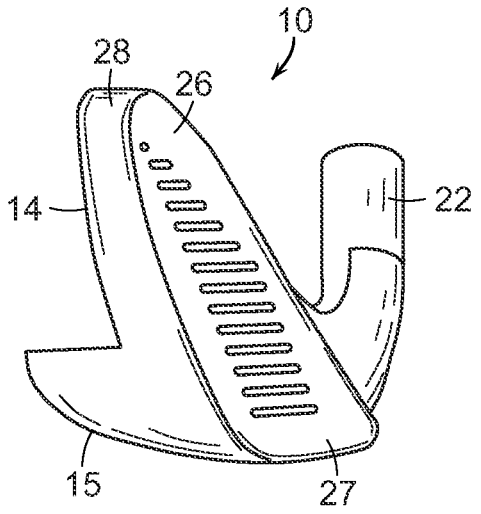
FIG. 4 is a toe-side view of the head of the ball striking device of FIG. 1.

As illustrated in FIGS. 1 and 4, the striking plate 26 includes a front face 27 which provides a contact area for engaging and propelling a golf ball in an intended direction. The front face 27 of the striking plate 26 may include grooves, texturing and/or inserts for optimizing the grip on the ball. Further, the ball striking plate 26 and/or the front face 27 may include some curvature in the top-to-bottom and/or heel-to-toe directions (e.g., bulge and roll characteristics). Even further, the striking plate 26 and/or the front face 27 may be inclined from the vertical (i.e., at a loft angle), to give the ball lift and/or spin when struck. Front face 27 may be provided with any of various bulge, roll, and/or loft characteristics, as are known and conventional in the art.

Further, as illustrated in FIGS. 1-5, the ball striking plate 26 includes a rear or back surface 30 on the side opposite the front face 27. According to certain aspects, one or more thickened portions 130 may extend rearwardly on the rear surface 30 of the ball striking plate 26 and creating one or more raised platforms or elevated areas on the rear surface 30 of the plate. The thickened portion 130 provides increased stiffness to and/or structurally reinforces certain areas or regions of the ball striking plate 26. Examples of ball striking plates, thickened plate portions, and golf club heads and clubs incorporating such are disclosed in U.S. patent application Ser. No. 13/211,961, filed Aug. 17, 2011, titled "Golf Club or Other Ball Striking Device Having Stiffened Face Portion," which is incorporated by reference herein in its entirety.

FIGS. 1-5 illustrate an embodiment of a head 14 with a plate 26 that includes the thickened portion 130 on the rear surface 30 of the plate 26. The thickened portion 130 includes an area that extends behind the geometric center 133 of the ball striking plate 26. Further, the thickened portion 130 may extend at least partially over the desired-contact region of the plate 26 with the ball. In other words, the region of the plate 26 most likely to contact the ball may be provided with a greater thickness than areas more removed from the desired-contact region.

The thickened portion 130 has a greater thickness than the surrounding or peripheral portion 140 of the plate 26. Peripheral portion 140 surrounds (or partially surrounds) the thickened portion 130 and extends from the thickened portion 130 to an edge of the frame 28 (if any). Thickened portion 130 includes an elevated area 132 and may include a transition area 134. According to some aspects and referring to FIG. 5, the thickened portion 130 may have a maximum thickness ($t_{130}$) of approximately 2.00 mm to approximately 4.50 mm and the peripheral portion 140 may have a maximum thickness ($t_{140}$) of approximately 1.20 mm to approximately 2.50 mm.

Figure 6:
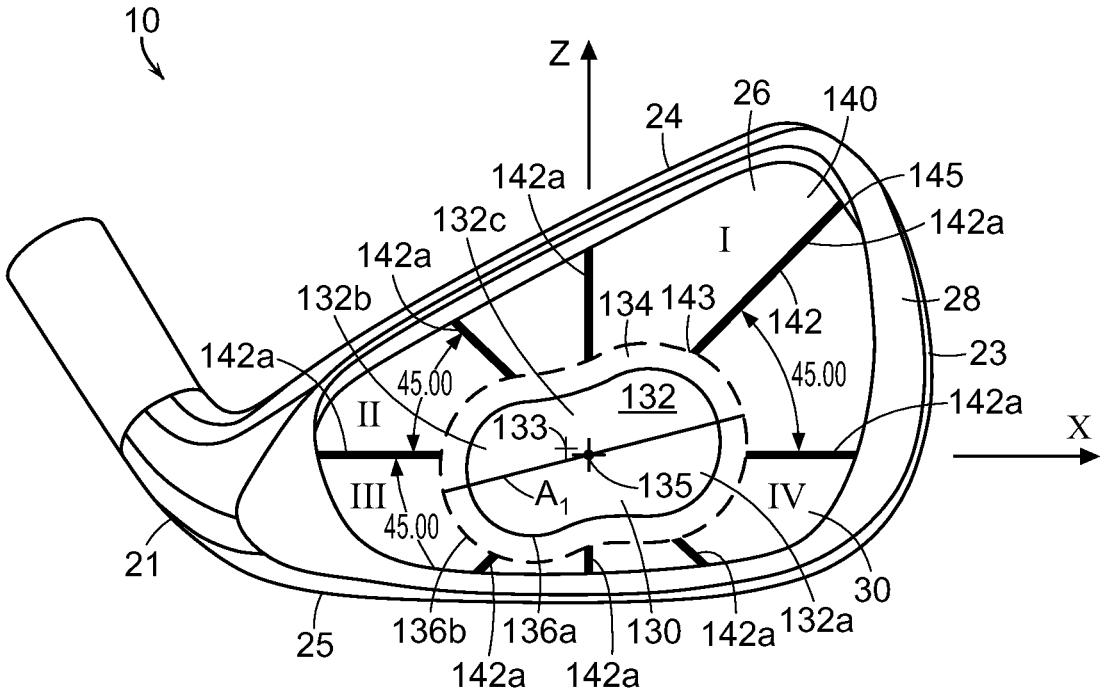
FIG. 6 schematically illustrates various characteristics of ball striking devices according to certain aspects of the invention. Specifically.

According to certain aspects, the thickened portion 130 may have any of various different shapes and configurations. For example, as best shown in FIG. 6, the thickened portion 130 of the plate 26 may have a generally peanut shape—two generally rounded lobes of equal (or unequal) size connected by a necked-down connector region. As shown, thickened portion 130 may include a first elevated area 132 bounded by contour edge 136*a*. In general, the elevated area 132 may have any suitable shape, including peanut shaped, kidney shaped, amoeba shaped (i.e., amorphous with curves), elliptical, round, pear shaped, oblate, square, hexagonal, star-shaped, etc.

In certain embodiments, the elevated level 132 may be formed as a plateau (i.e., a generally flat, non-inclined region) having generally constant thickness. Alternatively, the surface of the elevated level 132 may be formed with a tapered shape, a domed shape, a bowl shape, a saddle shape, a rippled shape, and/or combinations thereof, or other varying height surface. In other words, the thickness of the elevated level 132 may vary within its contour edge 136*a*.

According to some aspects, an annular transition area 134 may surround the elevated area 132 and extend between an upper contour edge 136*a* and a lower contour edge 136*b*. The thickness of the transition area 134 may decrease from the upper contour edge 136*a* to the lower contour edge 136*b*.

According to some aspects, and as best shown in FIG. 6, the upper contour edge 136*a* may define a double-lobed shape. Such a shape may be referred to as a "peanut" shape. Thus, the elevated level 132 may include a first lobe 132*a*, a second lobe 132*b*, and a connecting portion 132*c* extending between the lobes 132*a*, 132*b*. The connecting portion 132*c* is necked down (i.e. it has a smaller width than the lobes 132*a*, 132*b* on either side) such that it defines a waist. Typically, the first and second lobes 132*a*, 132*b* may be provided with convex contour edges and the connecting portion 132*c* may be provided with a concave contour edges. As shown in FIG. 6, the upper contour edge 136*a* may smoothly (i.e., without abrupt changes in contour shape) extend around the elevated level 132.

The lower contour edge 136*b* may generally follow the contour of the upper contour edge 136*a*. Thus, if the upper contour edge 136*a* follows a double-lobed shape, the lower contour edge 136*a* may also follow a double-lobed shape. Optionally, the shape of the lower contour edge 136*b* may deviate from the shape of the upper contour edge 136*a*. Thus, for example, the upper contour edge 136*a* may be peanut shaped, while the lower contour edge 136*b* may be kidney shaped, amoeba shaped, elliptical, round, pear shaped, etc.

Additionally, as shown in FIG. 6, an axis of elongation ($A_1$) is defined along the maximum dimension of the thickened portion 130. The axis of elongation ($A_1$) generally extends along the line of the two lobes 132*a*, 132*b*. Lobes 132*a*, 132*b* may each have dimensions measured along a second axis perpendicular to the axis of elongation ($A_1$) which are greater than the dimensions perpendicular to the axis of elongation in the connecting area 132*c*.

As shown in the embodiment of FIG. 6, the thickened portion 130 is more proximate the bottom edge 25 of the ball striking plate 26 than the top edge 24. By way of example, the center of the thickened portion 130 is approximately 15-22 mm from the bottom edge 25. This distance may be different in other embodiments.

For purposes of this disclosure, the striking plate 26 may be apportioned into quadrants. A predetermined point 135 (i.e., an origin) for the quadrants may be established. Although this predetermined point 135 may coincide with the geometric center 133 of the ball striking plate 26, in general it need not. Optionally, the predetermined point 135 for establishing the quadrants may be selected as the areal centroid of the thickened portion 130. Vertical (Z) and horizontal (X) lines extending through the predetermined point 135 define the four quadrants.

Thus, referring to FIG. 6, when the ball striking plate 26 is viewed from the back a first quadrant (I) may be defined as that portion of the striking plate 26 nearest the top edge 24 and the toe edge 23. This first quadrant (I) may also be referred to as the "high-toe area." A second quadrant (II) may be defined as that portion of the striking plate 26 nearest the top edge 24 and the heel edge 21. This second quadrant (II) may also be referred to as the "high-heel area." A third quadrant (III) may be defined as that portion of the striking plate 26 nearest the bottom edge 25 and the heel edge 21. This third quadrant (III) may also be referred to as the "low-heel area." A fourth quadrant (IV) may be defined as the portion of the striking plate 26 nearest the bottom edge 25 and the toe edge 23. This fourth quadrant (IV) may also be referred to as the "low-toe area." Conceptually, these areas may be recognized and referred to as quadrants of substantially equal size (and/or quadrants extending from a geometric center 133 of the striking plate 26), though not necessarily with symmetrical dimensions.

According to aspects of the invention and referring to FIGS. 2, 3, 5 and 6, the ball striking plate 26 of the ball striking device 10 may have one or more reinforcement elements. Reinforcement elements may include reinforcement ribs 142 extending along the rear surface 30 of the striking plate 26. Reinforcement ribs 142 may include one or more elongated, raised strips of material on the rear surface 30 of the plate. Ribs 142 may be formed as beads or filaments of material applied to the rear surface 30. Optionally, ribs 142 may be unitarily constructed with the ball striking plate 26 via molding, casting, machining, etching, etc. Ribs 142 may be formed as half-elliptical elements, half-round elements, square or rectangular wire, angles, c-channels, fins, etc.

According to other aspects, reinforcement ribs 142 may be provided as strips of material embedded in the plane of the ball striking plate. Reinforcement ribs may be formed as elongated regions of material having a greater elastic modulus than the surrounding material. This stiffer material may be partially or fully embedded in the surrounding material of the ball striking plate. Thus, according to certain embodiments, the reinforcement ribs 142 need not be raised above the rear surface of the plate. According to some embodiments, reinforcement ribs may be provided as filaments that are, for example, formed separately and place in a mold prior to filling the mold with the surrounding material. According to other embodiments, reinforcement ribs may be pre-tensioned prior to filling the mold.

Referring to FIG. 6, one or more reinforcement ribs 142 may be provided as thin, elongated features on the striking plate 26. Each reinforcement rib 142 may have a first end 143 and a second end 145. The first end 143 may be proximate the thickened portion and the second end 145 may be proximate the outer periphery or perimeter of the striking plate 26. Reinforcement ribs 142 may be linear, piece-wise linear and/or curved. The cross-sectional shape and area of the different reinforcement ribs 142 may be the same or different. Further, the cross-sectional area of any individual reinforcement rib 142 may increase, decreases or remain constant along its length.

In the embodiment of FIG. 6, a plurality of reinforcement ribs 142 are spoke-like reinforcement ribs 142*a* extending from the thickened portion 130 to the frame 28 and are provided on peripheral portion 140 of plate 26. In this particular embodiment, the geometric center 133 is located approximately at X=−1.2 mm and at Z=0.0 mm. This position of the geometric center 133 may change, especially for the various clubs heads, e.g., irons, drivers, etc. The predetermined point 135 is defined at X=0.0 mm and Z=0.0 mm. For other embodiments, the predetermined point 135 may be coincident with the geometric center 133 of the ball striking plate 26. Further, for certain embodiments, the predetermined point 135 may be coincident with a center of the thickened portion 130. Reinforcement ribs 142*a* are radially-aligned with and radiate away from the predetermined point 135. As shown, reinforcement ribs 142*a* extend between the lower contour edge 136*b* of the thickened portion 130 to the frame 28 located at the perimeter of the ball striking plate 26. In this particular embodiment, spoke-like reinforcement ribs 142*a* are evenly spaced apart by 45 degree angles. In other embodiments, spoke-like reinforcement ribs 142*a* may have a different angular spacing, which may or may not be equal.

Figure 7:
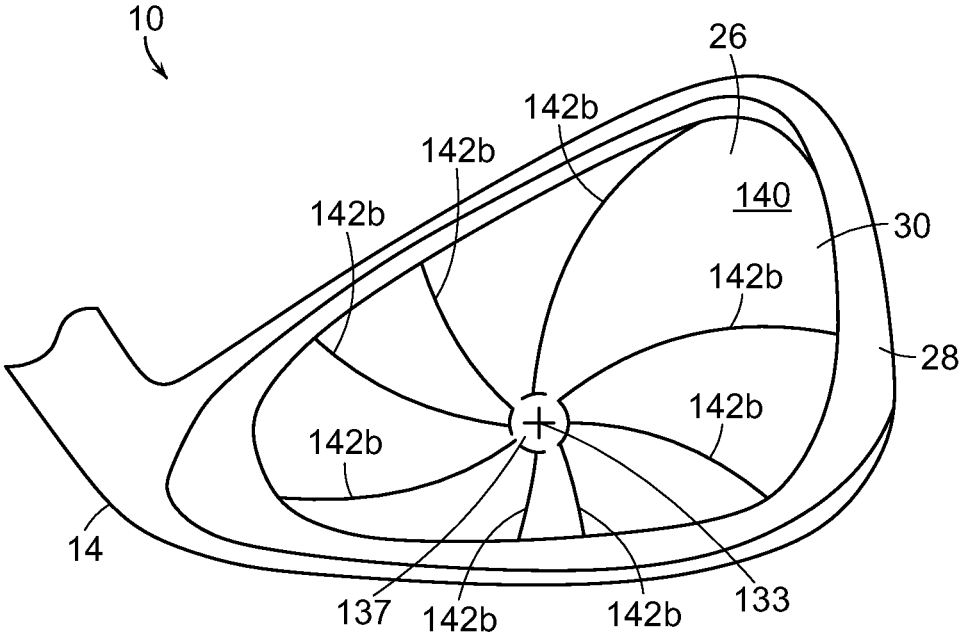
FIGS. 7-13 schematically illustrate various embodiments of ball striking devices according to additional aspects of the invention.

In the embodiment of FIG. 7, a plurality of spoke-like reinforcement ribs 142*b* radiate from a central region 137 of the ball striking plate 26. Reinforcement ribs 142*b* are curved. Central region 137 need not include a thickened portion.

Figure 8:
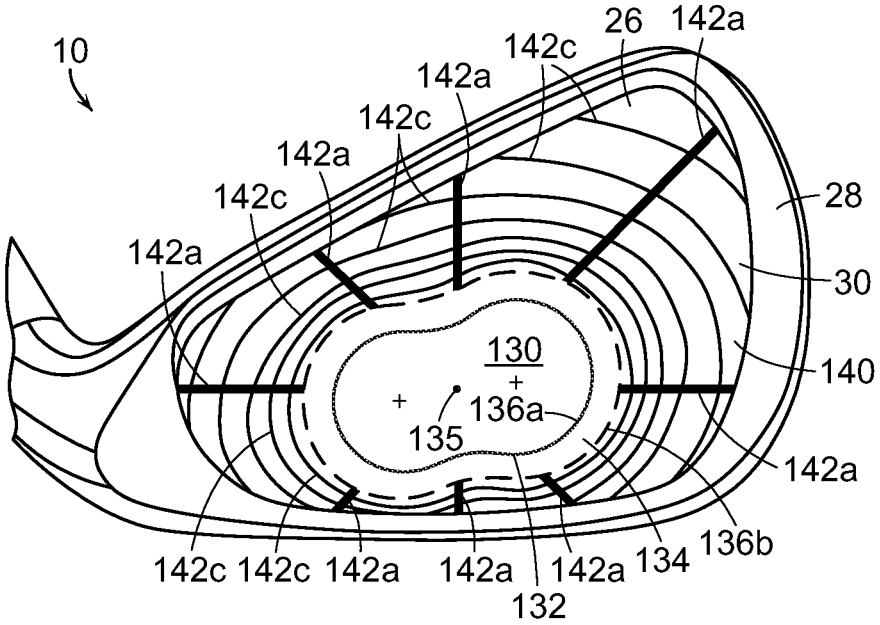

In the embodiment of FIG. 8, the plurality of radially-aligned reinforcement ribs 142*a* of FIG. 6 are provided, and additionally, a plurality of annularly-extending or encircling reinforcement ribs 142*c* are provided. The encircling reinforcement ribs 142*c* extend around the thickened portion 130 with a varying spacing between the adjacent encircling reinforcement ribs 142*c*. The reinforcement ribs 142*c* closer to the thickened portion 130 have a closer spacing than those reinforcement ribs 142*c* spaced farther from the thickened portion 130. In other words, the rib spacing increases as the distance from the center of the thickened portion 130 increases. Thus, for example, the innermost encircling reinforcement rib 142*c* (as measured along the vertically-extending quadrant line between the first and second quadrants) is spaced 1.50 mm from the thickened portion 130 and the other encircling reinforcement ribs 142*c* are spaced at 1.75 mm, 2.00 mm, 2.50 mm, 3.25 mm, 4.25 mm and 5.50 mm from the adjacent inner rib. In other embodiments, this spacing between adjacent encircling reinforcement ribs 142*c* may be constant or may decrease.

The encircling reinforcement ribs 142*c* may generally follow the contour of the thickened portion 130. Encircling reinforcement ribs 142*c* closer to the thickened portion 130 may more closely follow the shape of the contour of the thickened portion, while encircling reinforcement ribs 142*c* farther away from the thickened portion 130 may smooth out and loose some of the detail of the contour shape.

Further, the encircling reinforcement ribs 142*c* closest to the thickened portion 130 may form complete rings as shown in FIG. 8. Reinforcement ribs 142*c* that are located more towards the outer periphery of peripheral portion 140 may not form complete rings, but rather, they may extend from one section of frame 28 to another section of frame 28. Where encircling reinforcement ribs 142*c* cross over spoke-like reinforcement ribs 142*a*, they may be joined together (either integrally or unitarily).

In particular embodiment illustrated in FIG. 8, the spoke-like reinforcement ribs 142*a* have a constant cross-sectional area and the cross-sectional area of each of the ribs 142*a* are the same. Similarly, the encircling reinforcement ribs 142*c* have a constant cross-sectional area and the cross-sectional area of each of the ribs 142*c* are the same. In other embodiments, the ribs 142*a*, 142*c* need not have a constant cross-sectional area or equal cross-sectional areas. Further, in this particular embodiment, spoke-like reinforcement ribs 142*a* are provided with a cross-sectional area that is greater than the cross-sectional area of encircling ribs 142*c*. In other embodiments, ribs 142*a* may have the same or even a lesser cross-sectional area than ribs 142*c*.

Figure 9:
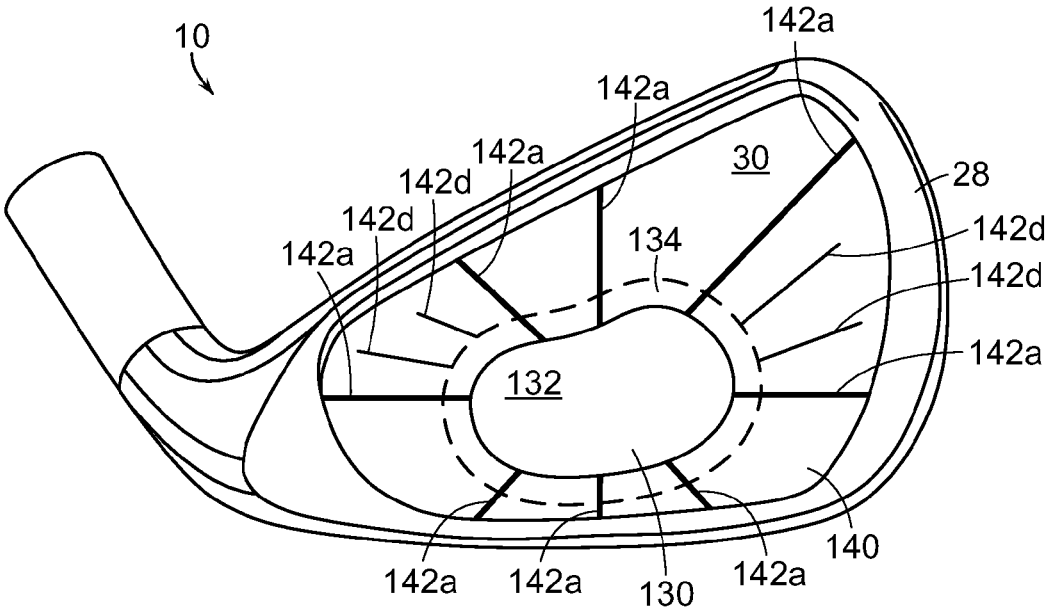

In the embodiment of FIG. 9, a plurality of spoke-like reinforcement ribs 142*a* are provided, and additionally, a second plurality of spoke-like reinforcement ribs 142*d* are provided. Spoke-like reinforcement ribs 142*d* extend from the thickened portion 130, but end before they reach frame 28. Further, in this particular embodiment, spoke-like reinforcement ribs 142*a* extend from the upper contour edge 136*a* of the thickened portion 130. Where ribs 142*a* extend over the transition area 134, the cross-sectional area of the ribs 142*a* may increase as the thickness of the transition area 134 decreases, thereby providing a smooth transition from the thickened portion 130. In contrast, spoke-like reinforcement ribs 142*d* are shown extending outward from the lower contour edge 136*b* of the thickened portion 130. One or both of the ends of ribs 142*d* may be tapered so as to more smoothly merge with the rear surface 30. Even further, in this particular embodiment, thickened portion 130 is provided with a kidney shape.

Figure 10:
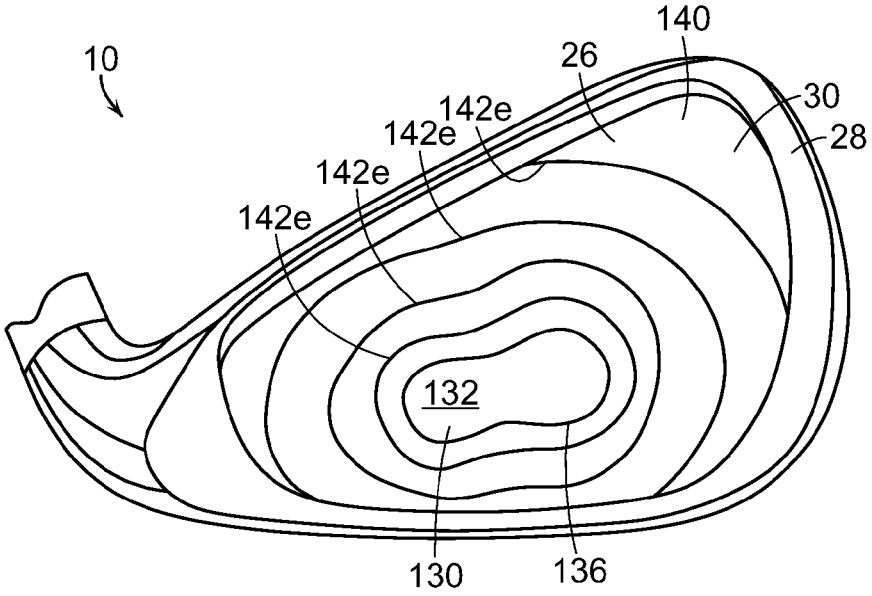

In the embodiment of FIG. 10, a plurality of encircling reinforcement ribs 142*e* are provided. These ribs 142*e* encircle a thickened portion 130 which includes an elevated area 132, but no transition area. Thus, in this particular embodiment, the contour edge 136 of the thickened portion 130 demarcates an abrupt change in thickness of the rear surface 30

Figure 11:
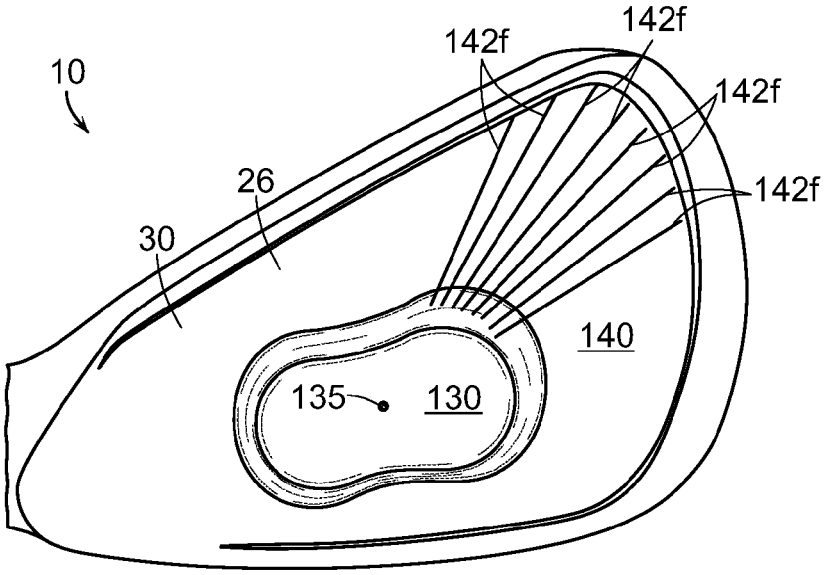

In the embodiment of FIG. 11, a plurality of spoke-like reinforcement ribs 142*f* are provided in a first quadrant of the plate 26. Reinforcement ribs 142*f* radiate away from predetermined point 135. In this particular embodiment, the reinforcement ribs 142*f* provided in the first quadrant include a first rib at 30 degrees from the horizontal with other ribs at 35, 40, 45, 55, 60, 65 and 70 degrees from the horizontal. Other angular spacings and locations, and fewer or more ribs may be provided in other embodiments.

Figure 12:
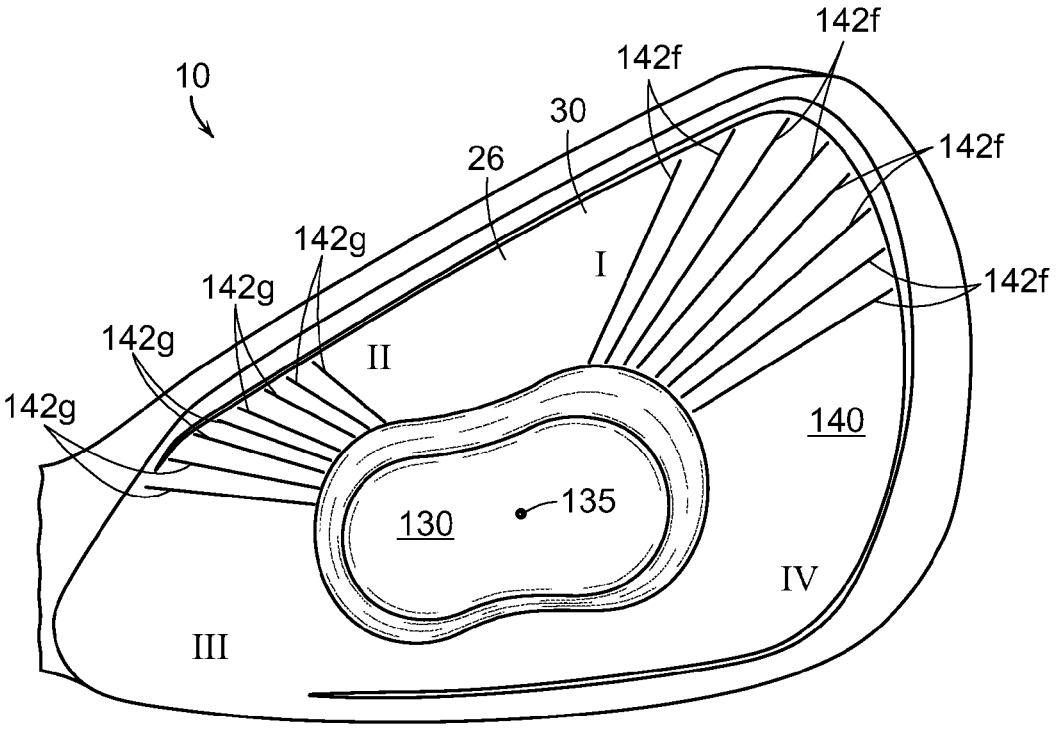

In the embodiment of FIG. 12, a plurality of spoke-like reinforcement ribs 142*f* are provided in a first quadrant of the plate 26 and a plurality of spoke-like reinforcement ribs 142*g* are provided in a second quadrant the plate 26. Both reinforcement ribs 142*f* and reinforcement ribs 142*g* radiate away from predetermined point 135. The reinforcement ribs 142*g* provided in the second quadrant include a first rib at 40 degrees from the horizontal with other ribs at 35, 30, 25, 20, 15, 10 and 5 degrees from the horizontal. Thus, it is understood that the spoke-like reinforcement ribs may be located in one or more of any of the quadrants—the upper-toe quadrant, the upper-heel quadrant, the lower-toe quadrant and/or the lower-heel quadrant of the rear surface.

Figure 13:
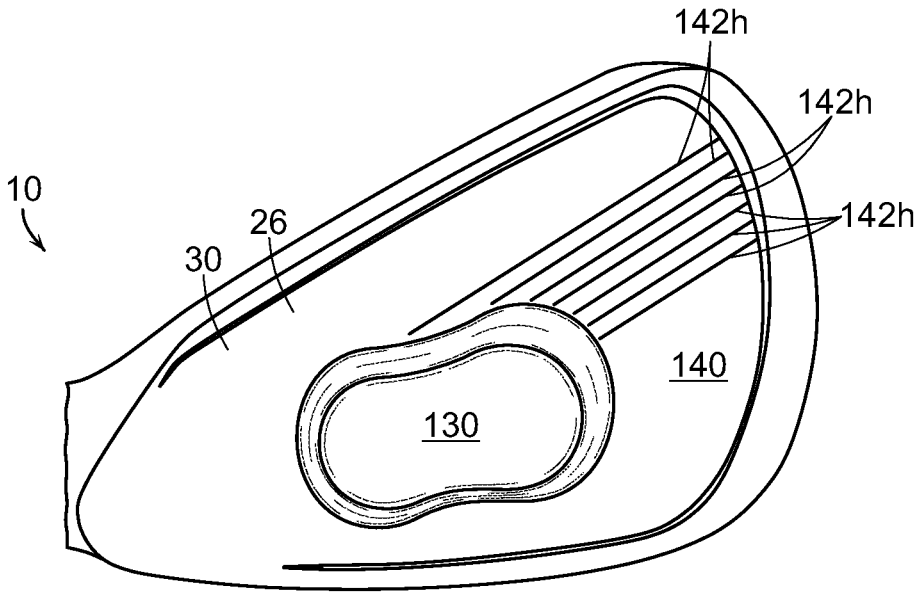

In the embodiment of FIG. 13, a plurality of spoke-like reinforcement ribs 142*h* are provided in a first quadrant of the plate 26. Reinforcement ribs 142*h* extend from thickened portion 130 to the perimeter of the ball striking plate 26. In this particular embodiment, the reinforcement ribs 142*h* provided in the first quadrant extend parallel to one another at an angle of approximately 30 degrees from the horizontal. Other angular orientations and locations, and fewer or more ribs may be provided in other embodiments.

In any or all of the above described embodiments, the thickness of the peripheral portion 140 of plate 26 in the vicinity of the reinforcement ribs 142 (for example, between adjacent ribs 142*f*) may be less than the thickness of the peripheral portion 140 of plate 26 away from the ribs. In other words, the area of plate 26 adjacent to the ribs 142 may be made thinner than the area of plate 26 where there are no ribs located. The ribs 142 may allow the thickness of plate 26 to be reduced by more efficiently carrying and distributing the loads due to hitting the golf ball. Thus, for example, referring to both FIGS. 5 and 12, the thickness of the peripheral portion ($t_{140}$) near and/or between ribs 142*f*, 142*g* in the first and second quadrants may be 1.80 mm, whereas the thickness ($t_{140}$) away from the ribs (i.e., in the third and fourth quadrants may be 2.00 mm. Alternatively, the thickness of the peripheral portion 140 may be constant over the entire peripheral portion, with the extra reinforcement provided by the reinforcement ribs (e.g., ribs 142*f*, 142*g*) generally allowing the plate thickness to be less than it would otherwise be.

Thus, referring to FIGS. 1-6, 8-9 and 11-13, one or more reinforcement ribs 142 may extend from a thickened portion 130 to the perimeter frame 28, i.e., a first end 143 may be joined to thickened portion 130 and a second end 145 may be joined to frame 28. Optionally, as shown in FIGS. 8 and 10, one or more reinforcement ribs 142 may extend from one portion of the frame 28 to another portion of the frame 28. Further, as shown in FIG. 7, the ball striking plate 26 need not include a thickened portion. Even further, one or more of the reinforcement ribs 142 may begin and/or end in the middle of the peripheral region 140. In other words, as shown in FIG. 9, a reinforcement rib 142 may extend from thickened portion 130 toward perimeter frame 28, but end before it reaches frame 28.

Figure 14:
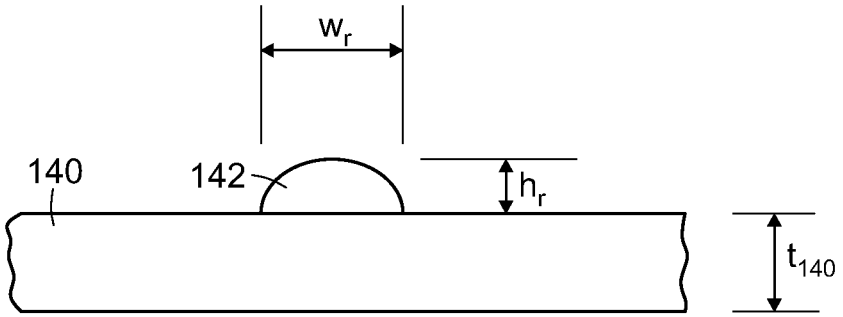
FIGS. 14-16 schematically illustrate various embodiments of reinforcement ribs on ball striking plates according to aspects of the invention.
Figure 15:
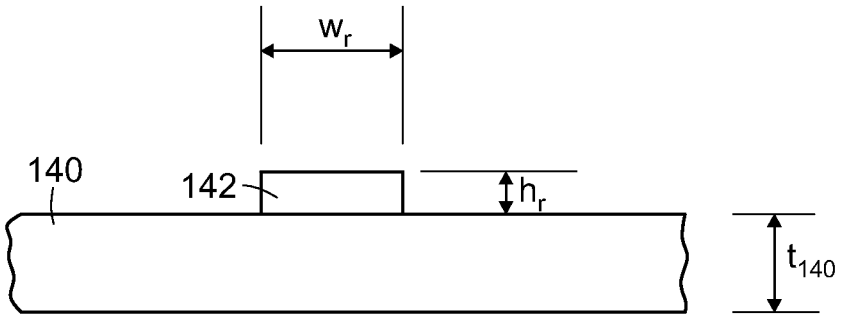
Figure 16:
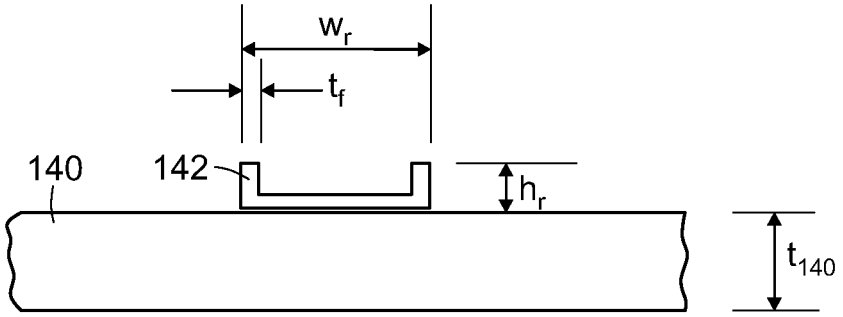

FIGS. 14-16 illustrate various cross-sectional features for several different embodiments of reinforcement ribs. Given the benefit of this disclosure, a person of skill in the art would understand that other suitable cross-sectional characteristics (shapes, dimensions, cross-sectional areas, etc.) of the reinforcement ribs could be provided.

As shown in FIG. 14, a reinforcement rib 142 may have a half-elliptical cross-section having a height ($h_r$) and a width ($w_r$). For this particular embodiment, the height ($h_r$) may be 0.40 mm and the width ($w_r$) may be 1.0 mm. Thus, this particular embodiment has a cross-sectional area ($a_r$) of 0.314 $mm^2$. Further, this particular embodiment of the reinforcement rib 142 has a height-to-width ratio of 0.4. Even further, if for this particular embodiment, the peripheral portion 140 of striking plate 26 has a thickness ($t_{140}$) of 1.80 mm, then the rib height-to-plate thickness ratio is 0.22.

As shown in FIG. 15, a reinforcement rib 142 may have a rectangular cross-section having a height ($h_r$) and a width ($w_r$). Thus, for this particular embodiment, if the height ($h_r$) is 0.30 mm and the width ($w_r$) is 0.8 mm, then the rib 142 has a cross-sectional area ($a_r$) of 0.240 $mm^2$. Further, this particular embodiment of the reinforcement rib 142 has a height-to-width ratio of 0.375. Even further, if this reinforcement rib 142 is provided on a peripheral portion 140 of striking plate 26 having a thickness ($t_{140}$) of 1.75 mm, then the rib height-to-plate thickness ratio is 0.17.

As shown in FIG. 16, a reinforcement rib 142 may have a U-shaped cross-section having a height ($h_r$) of 0.30 mm, a width ($w_r$) of 1.5 mm, and a flange thickness ($t_f$) of 0.15 mm. Thus, this particular embodiment has a cross-sectional area ($a_r$) of 0.315 $mm^2$. Further, this particular embodiment of the reinforcement rib 142 has a height-to-width ratio of 0.20. Even further, if this reinforcement rib 142 is provided on a peripheral portion 140 of striking plate 26 having a thickness ($t_{140}$) of 1.90 mm, then the rib height-to-plate thickness ratio is 0.16.

According to certain aspects, reinforcement ribs 142 may be integrally formed with striking plate 26. Optionally, reinforcement ribs 142 may be formed separately and subsequently applied to the rear surface 30 of striking plate 26. Even further, reinforcement ribs 142 may be formed directly on the rear surface 30 of striking plate 26. For example, the material of plate 26 that surrounds or extends alongside reinforcement ribs 142 may be etched or machined away, leaving the reinforcement ribs behind.

Figure 5:
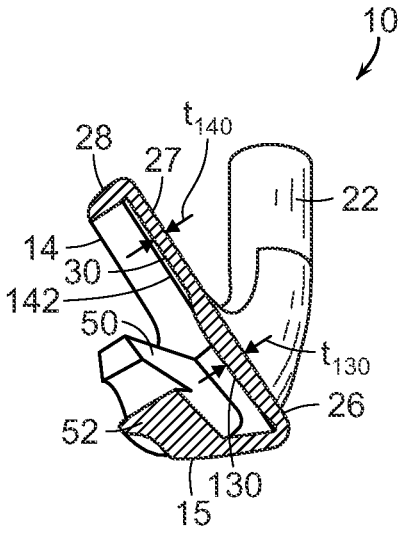
FIG. 5 is a cross-section view taken along line 3-3 of the head of the ball striking device of FIG. 1.

According to some embodiments and referring back to FIGS. 1-5, the ball striking plate 26 may be located at the front of a golf club head 14. The head 14 may further include a rear cavity 50 that is at least partially bounded by the rear surface 30 of the striking plate 26 and the frame 28. Further, a rear wall 52 may extend upward from the lower edge of the frame 28 at the rear 526 of the head 14, such that rear wall 52 defines at least a partial back wall of the rear cavity 50. As seen in FIG. 5, the rear wall 52 may leave the rear cavity 50 partially open. However, it is to be understood that in other embodiments the rear cavity 50 may be completely closed or may be open to a greater or lesser degree.

According to some embodiments, a striking plate 26 of a multi-piece golf club head 14 may be in the form of a substantially planar face plate, an L-shaped face member, a cup-face member, or another form. In other embodiments, a set of golf irons may have structures as described herein with the longer irons (e.g. 4-7) being formed of two pieces, including a striking plate 25 and a frame 28 joined by welding, and the shorter irons (e.g. 8, 9, P, S, A) being formed of a cast or forged single piece. For example, a single-piece head 14 may be made from 17-4 stainless steel, whereas a two-piece head 14 may be made with the frame 28 formed from 17-4 stainless steel and the striking plate 26 formed of 455 or 465 stainless steel.

The ball striking plate 26 as shown and described herein may be constructed from a wide variety of different materials, including materials conventionally known and used in the art, such as steel, titanium, aluminum, tungsten, graphite, polymers, or composites, or combinations thereof. More specific examples of such materials that may be used to form ball striking plate 26, including thickened portions 130 and/or reinforcement ribs 142 as described herein, include those described above, including high strength stainless steels such as C455 and C465, other stainless steels such as 17-4, other steels such as maraging steels (e.g. Maraging 250) or AerMet steels or Nexcor steels, high strength titanium alloys such as 6-4, SP700, 8-1-1, 15-3-3-3, and 2041, PEEK polymer with or without fiber reinforcement, amorphous "liquid metal" alloys, bulk modulus composites, etc. High strength alloys and other materials having yield strengths of approximately 230-240 ksi or greater and ultimate strengths of approximately 250-260 ksi or greater may be desirable. In one embodiment, the striking plate 26 of a fairway wood or hybrid-type club may be made from C465 alloy having a yield strength of at least 240 ksi and an ultimate tensile strength of at least 260 ksi. In another embodiment, the ball striking plate 26 of a driver wood-type club may be made from a high strength titanium alloy (e.g. 6-4) having a yield strength of approximately 120-150 ksi or greater and an ultimate tensile strength of approximately 130-165 ksi or greater. In a further embodiment, the plate 26 of a driver wood-type club may be made from a 15-3-3-3 titanium alloy that may have a yield strength of approximately 145-181 ksi or greater and an ultimate tensile strength of approximately 165-200 ksi or greater.

The body 15 of golf club head 14 may also be constructed of various materials such as steel, titanium, aluminum, tungsten, graphite, polymers, plastics, composites or the like. It is understood that the body 15 may be unitarily formed as a single piece or as separate pieces that are joined together. For example, the body 15 may be formed as separate pieces (i.e., the frame 28, a hosel 22, etc.) which are subsequently joined by integral joining techniques, such as welding, cementing, or adhesively joining Other known techniques for joining these parts can be used as well, including many mechanical joining techniques, such as releasable mechanical engagement techniques.

The reduction in weight of the ball striking face 26 achieved by efficiently channeling loads and selectively stiffening portions of the face 26 may result in an increase in the coefficient of restitution (COR). Alternatively or in addition, the COR may be set at the prevailing USCA limit (e.g., 0.83) while reducing the weight of the club head, improving the dynamic response and/or improving the durability of the ball striking face. Even further, the area of the ball striking face 26 having the highest COR may be increased, such that even off-center hits may result in increased energy being transferred to the ball, thereby increasing the distance of the shot.

Any of the embodiments of ball striking devices 10, golf club heads 14, ball striking plates 26, and other components described herein may include any of the features described herein with respect to other embodiments described herein, unless otherwise noted. The specific sizes, shapes, orientations, and locations of various components of the ball striking devices 10 and heads 14 described herein are simply examples, and that any of these features or properties may be altered in other embodiments. The desired shapes, orientations, configurations, etc. of the thickened portions 130, the reinforcement ribs 142 and/or other portions of the ball striking plate 26 may be altered to achieve different impact physics or to account for changes to other portions of the golf club head 14. Further, different types of ball striking devices may be manufactured according to the principles described herein.

In general, golf club head 14 may be any driver, wood, hybrid, iron, wedge, putter or the like. The golf club head 14 of FIGS. 1-5 may be representative of an iron-type golf club head according to the invention. The shape and design of the golf club head 14 may be dictated by the intended use of the device 10. For example, a golf club head 14 having a relatively large volume and an enclosed cavity may be suitable for use as a driver or wood-type golf club, which is intended to hit the ball accurately over long distances. When configured as a driver-type golf club, the head 14 may have a volume of at least 400 cc, and in some structures, at least 450 cc, or even at least 460 cc. In other applications, such as for a different type of golf club, the head may be designed to have different dimensions and configurations. For example, the head 14 suitable for use as a wedge-type golf club may have a smaller cavity or no inner cavity at all. Golf clubs and golf club heads may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A ball striking device comprising:

a ball striking plate having a front surface configured to strike a ball and a rear surface opposite the front surface, the ball striking plate having a desired-contact region and a perimeter; and, further comprising a thickened portion of the ball striking plate, the thickened portion including an elevated area on the rear surface of the ball striking plate positioned behind the desired-contact region of the ball striking plate, and wherein the thickened portion is a plateau area having a generally constant thickness surrounded by a peripheral portion of the rear surface of the ball striking plate having a smaller thickness than the thickened portion, and one or more spoke-like reinforcement ribs located on the rear surface and extending away from the desired-contact region toward the perimeter;

at least three encircling reinforcement ribs located on the rear surface, the at least three encircling reinforcement ribs at least partially encircling the desired-contact region, wherein a spacing from one another among the at least three encircling reinforcement ribs increases as a distance from the desired-contact region increases;

wherein the thickened portion has a length and a width, wherein the length of the thickened portion is elongated along an axis of elongation;

wherein the length of the thickened portion along the axis of elongation is greater than the width of the thickened portion.

2. The ball striking device of claim 1, wherein at least one of the one or more spoke-like reinforcement ribs ends before reaching the perimeter of the ball striking plate.

3. The ball striking device of claim 1, wherein at least one of the one or more spoke-like reinforcement ribs is located in an upper-toe quadrant of the rear surface.

4. The ball striking device of claim 3, wherein at least one of the one or more spoke-like reinforcement ribs is located in an upper-heel quadrant of the rear surface.

5. The ball striking device of claim 3, wherein at least one of the one or more spoke-like reinforcement ribs includes a plurality of spoke-like reinforcement ribs that are evenly spaced from one another.

6. The ball striking device of claim 1, wherein at least one of the one or more spoke-like reinforcement ribs has a maximum cross-sectional area ranging from 0.20 $mm^2$ to 0.50 $mm^2$.

7. The ball striking device of claim 1, wherein at least one of the one or more spoke-like reinforcement ribs and at least one of the encircling reinforcement ribs intersect.

8. The ball striking device of claim 1, wherein at least one of the one or more encircling reinforcement ribs completely encircles the desired-contact region.

9. The ball striking device of claim 1, wherein the thickened portion further includes a transition area that tapers in thickness between an upper boundary that defines a perimeter of the elevated area and a lower boundary that defines a perimeter of the thickened portion.

10. The ball striking device of claim 1, wherein the elevated area has a peanut shape.

11. The ball striking device of claim 1, wherein the elevated area has a kidney shape.

12. A ball striking device comprising:

a ball striking plate having a front surface configured to strike a ball and a rear surface opposite the front surface, the ball striking plate having a desired-contact region and a perimeter; and, further comprising a thickened portion of the ball striking plate, the thickened portion including an elevated area on the rear surface of the ball striking plate positioned behind the desired-contact region of the ball striking plate, and wherein the thickened portion is a plateau area having a generally constant thickness surrounded by a peripheral portion of the rear surface of the ball striking plate having a smaller thickness than the thickened portion, and at least three encircling reinforcement ribs located on the rear surface, the at least three encircling reinforcement ribs at least partially encircling the desired-contact region, wherein a spacing from one another among the at least three encircling reinforcement ribs increases as a distance from the desired-contact region increases;

wherein at least one of the at least three encircling reinforcement ribs partially encircles the desired-contact region and has a first end and a second end, and wherein the first end is joined to a first portion of the perimeter of the ball striking plate and the second end is joined to a second portion of the perimeter of the ball striking plate.

13. The ball striking device of claim 12, further including a body connected to the ball striking plate to thereby form a golf club head, the body configured for engagement to a shaft.

14. A ball striking device comprising:

a ball striking plate having a front surface configured to strike a ball and a rear surface opposite the front surface, the ball striking plate having a desired-contact region and a perimeter;

a thickened portion of the ball striking plate, the thickened portion including an elevated area on the rear surface of the ball striking plate positioned behind the desired-contact region of the ball striking plate; and a plurality of reinforcement ribs located on the rear surface, the plurality of reinforcement ribs including at least one of a spoke-like reinforcement rib extending away from the desired-contact region and at least three encircling reinforcement ribs at least partially encircling the thickened portion, wherein a spacing from one another among the at least three encircling reinforcement ribs increases as a distance from the desired-contact region increases.

15. The ball striking device of claim 14, wherein at least one of the reinforcement ribs has a maximum cross-sectional area ranging from 0.10 $mm^2$ to 0.70 $mm^2$.

16. The ball striking device of claim 14, wherein the at least three encircling reinforcement ribs partially encircle the thickened portion and have a first end and a second end, and wherein the first end is joined to a first portion of the perimeter of the ball striking plate and the second end is joined to a second portion of the perimeter of the ball striking plate.

17. The ball striking device of claim 14, wherein the thickened portion further includes a transition area that tapers in thickness between an upper boundary that defines a perimeter of the elevated area and a lower boundary that defines a perimeter of the thickened portion.

18. The ball striking device of claim 14, wherein the elevated area has one of a peanut shape and a kidney shape, and wherein the at least three encircling reinforcement rib have the same general shape as the shape of the elevated area.

19. The ball striking device of claim 14, further including a body connected to the ball striking plate to thereby form a golf club head, the body configured for engagement to a shaft.

20. A golf club comprising the ball striking device of claim 19 and the shaft engaged with the golf club head.

* * * * *